US007682294B2

(12) United States Patent
Piane, Jr.

(10) Patent No.: US 7,682,294 B2
(45) Date of Patent: Mar. 23, 2010

(54) MEDICAL ANALYSIS AND RECORDING SYSTEM

(75) Inventor: Robert A. Piane, Jr., Newark, DE (US)

(73) Assignee: BVP Holding, Inc., Newark, DE (US)

( * ) Notice: Subject to any disclaimer, the term of this patent is extended or adjusted under 35 U.S.C. 154(b) by 296 days.

(21) Appl. No.: 11/491,750

(22) Filed: Jul. 24, 2006

(65) Prior Publication Data

US 2007/0054786 A1 Mar. 8, 2007

Related U.S. Application Data

(60) Provisional application No. 60/714,746, filed on Sep. 7, 2005, provisional application No. 60/749,512, filed on Dec. 12, 2005.

(51) Int. Cl.
*A63B 21/08* (2006.01)

(52) U.S. Cl. ..... 482/97; 434/247; 434/308; 482/92

(58) Field of Classification Search ..... 482/92–103, 482/139, 1–9; 434/247, 262, 308, 258
See application file for complete search history.

(56) References Cited

U.S. PATENT DOCUMENTS 4,919,418 A 4/1990 Miller
5,433,678 A * 7/1995 Chi ..... 482/1
5,785,632 A * 7/1998 Greenberg et al. ..... 482/5
6,093,119 A * 7/2000 Tipton ..... 473/438
6,224,519 B1 * 5/2001 Doolittle ..... 482/98
6,342,028 B1 * 1/2002 de Sane ..... 482/1
7,001,312 B2 * 2/2006 Alessandri et al. ..... 482/54
7,220,221 B2 * 5/2007 Mosimann et al. ..... 482/100
7,278,958 B2 * 10/2007 Morgan ..... 482/97
7,350,426 B2 * 4/2008 Blakesley et al. ..... 73/862.391

* cited by examiner

*Primary Examiner*—Lori Baker
(74) *Attorney, Agent, or Firm*—Karl F. Milde, Jr.; Eckert Seamans Cherin & Mellott, LLC

(57) ABSTRACT

A system is disclosed for monitoring, recording and analysis of exercise in an exercise machine of the type which uses a cable, having a proximal end and a distal end, and a device, such as a handle, that enables a user to push or pull the proximal end of the cable against a resistance that is coupled to the distal end of the cable. A sensor or "load cell" mounted on the frame structure of the machine, for producing an electronic signal representing the instantaneous tensile force in the cable, and an electronic computer or the like, coupled to receive the electronic signal, for storing values representing the tensile force in the cable as a function of time.

20 Claims, 7 Drawing Sheets

MEDICAL ANALYSIS AND RECORDING SYSTEM

CROSS-REFERENCE TO RELATED PATENTS AND PATENT APPLICATIONS

This application claims priority from Provisional Patent Application No. 60/714,746, filed Sep. 7, 2005, entitled "MEDICAL ANALYSIS AND RECORDING SYSTEM" and Provisional Application No. 60/749,512, filed Dec. 12, 2005, entitled "MEDICAL ANALYSIS AND RECORDING SYSTEM".

This present application relates to subject matter disclosed in the U.S. Pat. No. 6,705,976 entitled "EXERCISE APPARATUS"; U.S. patent application Ser. No. 09/965,032, filed Sep. 27, 2001, entitled "WEIGHT SYSTEMS FOR EXERCISE EQUIPMENT"; and U.S. patent application Ser. No. 10/736,807, filed Dec. 15, 2003, entitled "EXERCISE APPARATUS USING WEIGHTS FOR HIGH-SPEED TRAINING".

BACKGROUND OF THE INVENTION

The present invention relates to exercise equipment of the type having a cable, the proximal end of which is attached to a device, such as a handle, that is pulled or pushed by a user against a restraining force imparted by a resistance device that is coupled to the cable's distal end. Exercise equipment of this type is well known and is disclosed, for example, in my U.S. Pat. Nos. 5,102,122 and 6,705,976, both of which are incorporated herein by reference.

As used herein, the term "cable" is intended to mean and include any elongate flexible member, such as a steel cable, plastic coated steel cable, stranded rope, flexible wire, or a strap or strip made of plastic, leather or rubber. The cable has "proximal" or near end, to which the user applies a force, and a "distal" or remote end attached to a resistance device. The device attached to the proximal end that is pushed or pulled by a user may, for example, be a handle that is grasped by the user's hand, a pad that is pressed by the user's body or a strap that is tied around the user's waist and pulled by the user.

The resistance device is normally a weight stack; that is, a stack of weights which are mounted to slide vertically on one or more guide rails. The distal end of the cable is coupled to a device that may be connected to one or more weights to allow the user to select the number of weights to be lifted when pulling or pushing the handle. The resistance force applied by the weights is substantially constant, independent of the height that the weights are lifted, but their substantial inertia applies a strong acceleration-dependent tensile force to the cable.

Other types of resistance devices, which may be used alone or in combination with a weight stack, are disclosed in my co-pending patent applications Ser. Nos. 09/965,032 and 10/736,807, referenced above. These include one or more elastic bands or springs, coupled to the distal end of the cable, to apply a distance-dependent tensile force to the cable. In addition, or in the alternative, the resistance device may include one or more damping devices coupled to the distal end of the cable to apply a speed-dependent tensile force to the cable.

Various systems are known for monitoring and recording the user's performance in an exercise machine. The U.S. Pat. No. 6,669,600 discloses a system for collecting work and power performance data on any type of exercise equipment. This system remotely senses movements of the limb of a person's body, such as an arm or leg, and records them with a time stamp. Movements of the limb are detected by a magnetic sensor, attached to the exercise equipment, which senses motions of small magnet on the limb. The sensor signals are digitized and supplied to a computer for analysis. If a weight stack machine is used, the weight and distance of travel must be entered separately into the computer, e.g., by a keyboard.

Several devices are known which can automatically determine the number of weights selected in an exercise machine having a weight stack. These are disclosed, for example, in the U.S. Pat. Nos. 5,785,632 and 6,358,188 and in the U.S. Patent Publication No. 2003/0211916. These systems are equipped with special purpose devices, such as a bar code reader or the like, which determines the number of weights which have been selected.

The U.S. Patent Publication 2003/0069108 discloses a monitoring system for a weight stack-type exercise machine which counts the number of times that weights are lifted within a prescribed period of time. The number of weights lifted can be entered into the device by means of a keypad.

The U.S. Pat. No. 5,800,310 discloses a machine for measuring the force exerted by the user's muscles and displaying the strength of the muscles at different positions of the user's body part. In order to measure the static strength of a user's lumbar muscles, the machine utilizes a strain gauge connected between a movement arm and the frame of the machine. Forces applied to the strain gauge are converted into an electric signal which is digitized and stored in a digital computer.

While this exercise equipment does utilize a cable coupled at its distal end to a weight stack, it is designed for very small movements which can be measured by the compression applied to the strain gauge.

None of the exercise machines disclosed in this prior art provide means for monitoring and recording the tension in a cable that is provided by the resistance device coupled to the distal end of the cable.

SUMMARY OF THE INVENTION

A principal object of the present invention, therefore, is to provide a system for monitoring, recording and analysis of exercise in an exercise machine of the type which uses a cable, having a proximal end and a distal end, and which has a device that enables a user to push or pull the proximal end of the cable against a resistance that is coupled to the distal end of the cable.

This object, as well as further objects which will become apparent from the discussion that follows, are achieved, in accordance with the present invention, by providing a sensor or "load cell" mounted on the frame structure of the machine, for producing an electronic signal representing the instantaneous tensile force in the cable, and an electronic computer or the like, coupled to receive the electronic signal, for storing values representing the tensile force in the cable as a function of time.

According to the invention, other sensors may also be mounted on the frame structure of the exercise machine for simultaneously monitoring other aspects of the user's performance during the exercise. In particular, a second sensor is preferably mounted on the frame structure to produce a second electronic signal representing the instantaneous longitudinal position of the cable. Alternatively, or in addition, a third sensor is preferably mounted on the same structure for producing a third electronic signal representing the instantaneous speed of the cable. Alternatively or in addition, a fourth sensor is preferably mounted on the same structure for producing a fourth electronic signal representing the instantaneous direction of egress of the cable from the frame structure at the point where the cable exits the machine.

Outputs from the second, third and/or fourth sensor are also transmitted to the electronic computer for storing their respective values as a function of time.

The second and third sensors which measure the position and speed of the cable may be combined. Once the instantaneous position of the cable is known as a function of time, the speed of the cable can be calculated.

The parameters which are sensed and transmitted to the computer may be processed to produce a display or to print a report.

The exercise machine may be designed to provide a 1:1 ratio between the tensile force applied to the cable and the resistance applied by the resistance device. It may also be designed to provide a 1:2 ratio between the tensile force in the cable and the resistance applied by the resistance device. Other ratios of tensile force to applied resistance are also possible, as is known in the art by passing the cable through one or more pulleys.

For a full understanding of the present invention, reference should now be made to the following detailed description of the preferred embodiments of the invention as illustrated in the accompanying drawings.

DETAILED DESCRIPTION OF THE PREFERRED EMBODIMENTS

Figure 1:
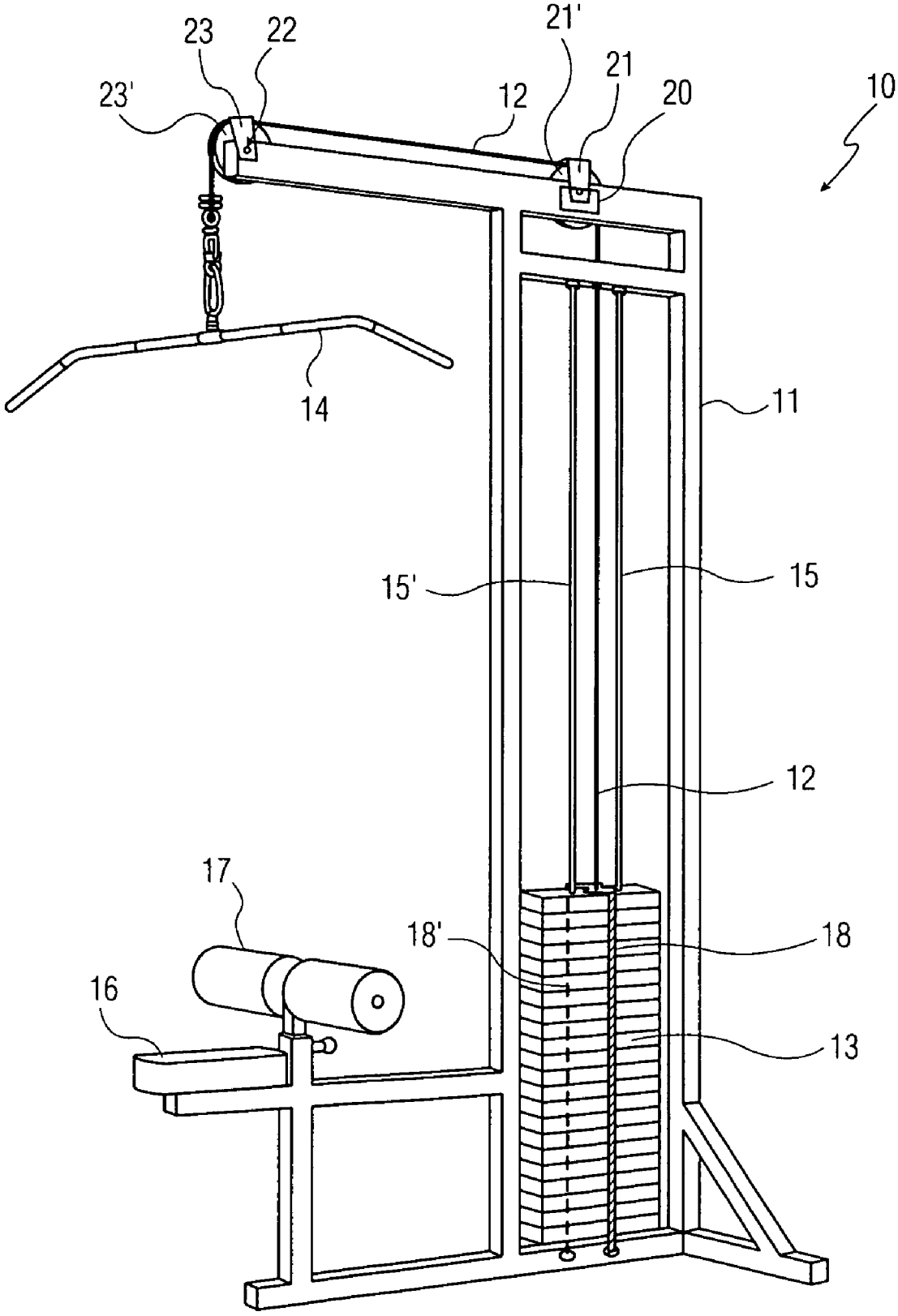
FIG. 1 is a perspective view of an exercise machine of the type with which the user applies a force to a handle attached to the proximal end of a cable. The tensile force in the cable is monitored by an electronic sensor or load cell.

The preferred embodiments of the present invention will now be described with reference to FIGS. 1-8 of the drawings. Identical elements in the various figures are designated with the same reference numerals.

The exercise monitoring and recording system according to the present invention is designed to attach to most, if not all, existing cable-based resistance exercise equipment to record the progress of a user's performance in exercising over time. Such a record is useful in the fields of sports performance for training and assessment as well as for medical rehabilitation. This system is particularly adapted for use with the exercise equipment which is shown and described in the U.S. Pat. Nos. 5,102,122 and 6,705,976, both of which have been incorporated herein by reference.

The system according to the present invention has at least one electronic sensor or "load cell" for monitoring the amount of resistance and/or the tensile force in the cable. The system also includes an analog to digital converter, to convert the output of the sensor into digital signals, and a computer comprising a microprocessor, memory, display and printer and the firmware and software to run the system (using Windows XPPro, for example), all bundled together. The information obtained by the system is paired with the user's personal data for storing and tracking the results of exercise.

The software is preferably "user friendly" so that it can be shared with other known software designed to record such things as an athlete's total performance history or a patient's medical history, as well as to be used for insurance billing purposes. The particular software used for data storage and analysis, however, forms no part of this invention.

In addition to the load cell, an encoder is arranged adjacent to the cable, or coupled to a cable pulley, to produce a real-time readout of the instantaneous position of the cable. From this data it is possible to calculate the distance and speed that the cable is pulled by the user in opposition to the resistance.

The load cell that determines the tensile force in the cable can be positioned at a number of different locations. In particular, the load cell can be connected between the distal end of the cable and its point of connection to the frame of the exercise equipment. Alternatively, the load cell may be mounted beneath the weight stack of an exercise machine which uses weights as a resistance device, to measure the remaining weight after the upper weights in the weight stack have been lifted. A simple subtraction therefore produces the force of the resistance.

Alternatively, the load cell may be mounted in the bracket which holds a cable pulley to the frame of the exercise equipment.

The various arrangements for measuring the tensile force in the cable will be described below in connection with FIGS. 1-6 of the drawings.

The present invention is intended to monitor and record a user's performance in a cable-based exercise machine. Such exercise equipment can be designed to interface with the human body in an almost infinite number of ways. The monitoring and recording system according to the invention will allow for cable-based exercise equipment to be monitored for an almost infinite variety of exercises.

In addition to monitoring the cable tension, cable speed, and distance of travel that the cable is pulled by the user in opposition to the resistance, additional sensors can be added that track the angle of the cable travel in 3-D space relative to fixed points on the user as well as the egress point from the exercise machine. This data can then be utilized for a more complete assessment of user performance.

As explained above, the resistance device can be a weight stack, one or more elastic bands (springs), one or more hydraulic or pneumatic damping devices, or any combination of these.

As an example, FIG. 1 shows an exercise machine 10 comprising a frame structure 11 and a cable 12. The cable is connected at its distal end to a weight stack 13 comprising a plurality of weights which can slide vertically on guide rods 15 and 15'. The resistance provided by the weight stack may be adjusted by selecting the number of weights lifted by the cable.

The opposite, proximal end of the cable is connected to a handle 14 which allows the cable to be pulled or pushed by a user in any desired direction away from the frame structure. The user may stand or may be in a prone or sitting position with the aid of the cushion devices 16 and 17.

In addition to the weight stack 13, the resistance device may include one or more elastic bands 18 and 18' which are stretched between the top of the first (highest) weight in the weight stack and the base of the frame structure 11. Whereas the weights in the weight stack apply a constant and an acceleration-dependent tensile force to the cable, the elastic bands apply a distance-dependent tensile force to the cable. Like the weights in the weight stack, elastic bands 18 and 18' are designed to be added or removed to adjust the tensile force applied to the cable.

According to the invention, the tensile force in the cable is measured by a load cell 20 disposed at the top of the frame structure. This load cell is connected between the frame structure 11 and a bracket 21 which supports a pulley 21' for the cable 12.

A second sensor or encoder 22 is provided on a bracket 23 to monitor the angular position of a pulley 23' at the point of egress of the cable from the exercise machine.

Electronic signals from the load cell 20 and the encoder 22 are passed to a respective analog to digital (A/D) converter. Outputs from the converter are supplied to a conventional laptop or desktop computer for recording and processing.

Figure 2:
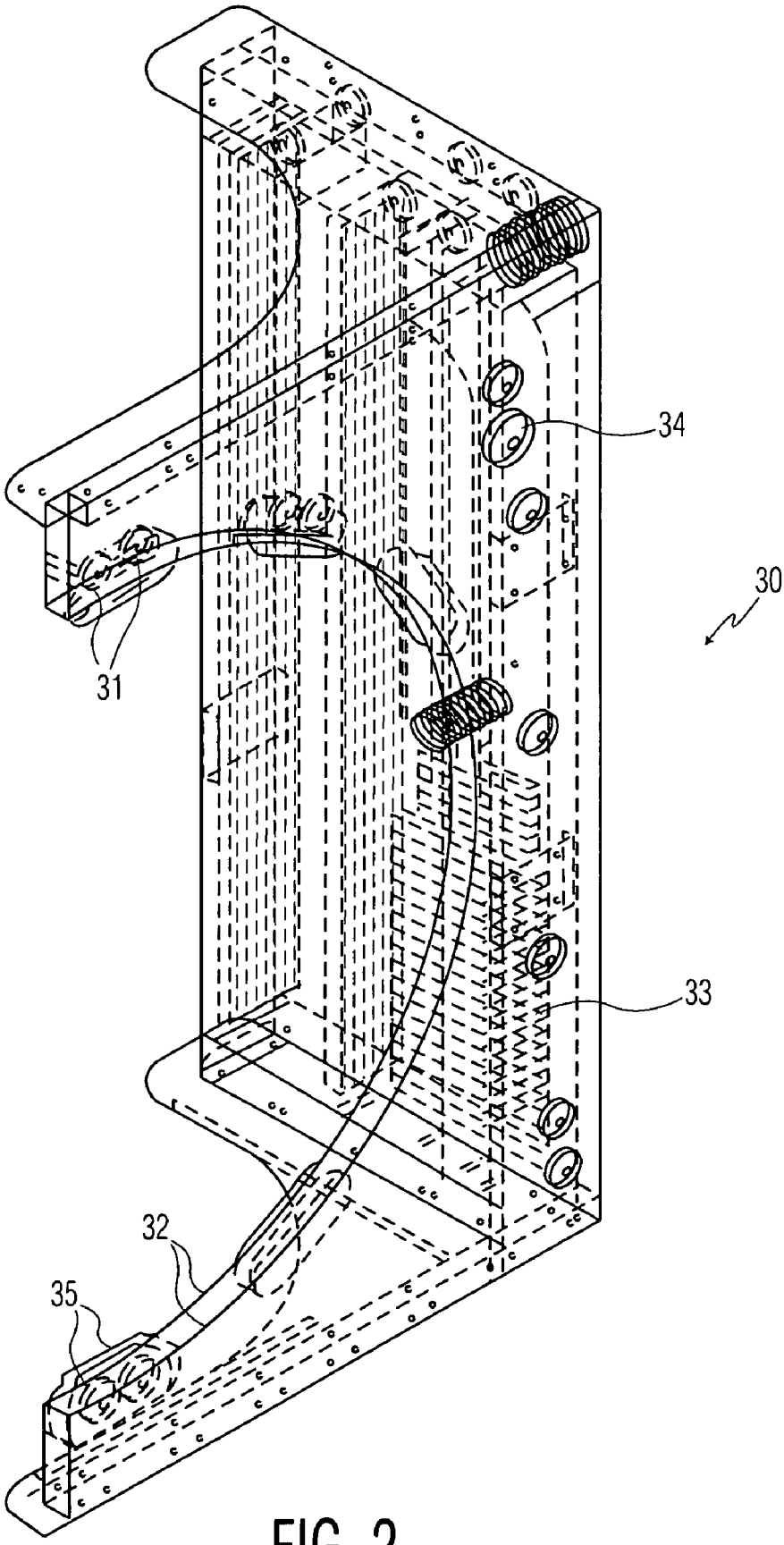
FIG. 2 is an isometric perspective view of another type of exercise machine which his more fully disclosed in my U.S. Pat. No. 6,705,976.
Figure 3:
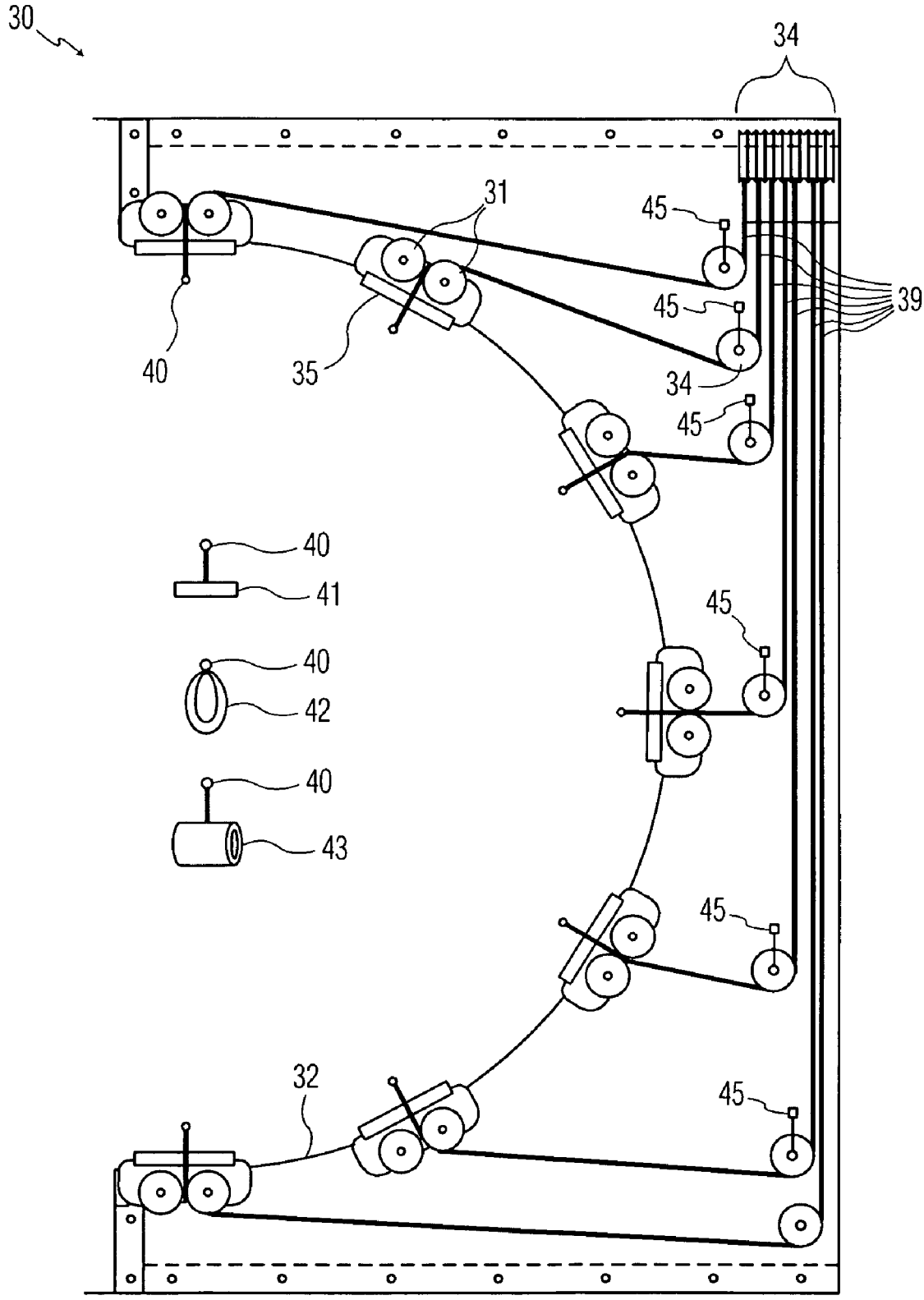
FIG. 3 is a cutaway side view of the exercise machine of FIG. 2.
Figure 4:
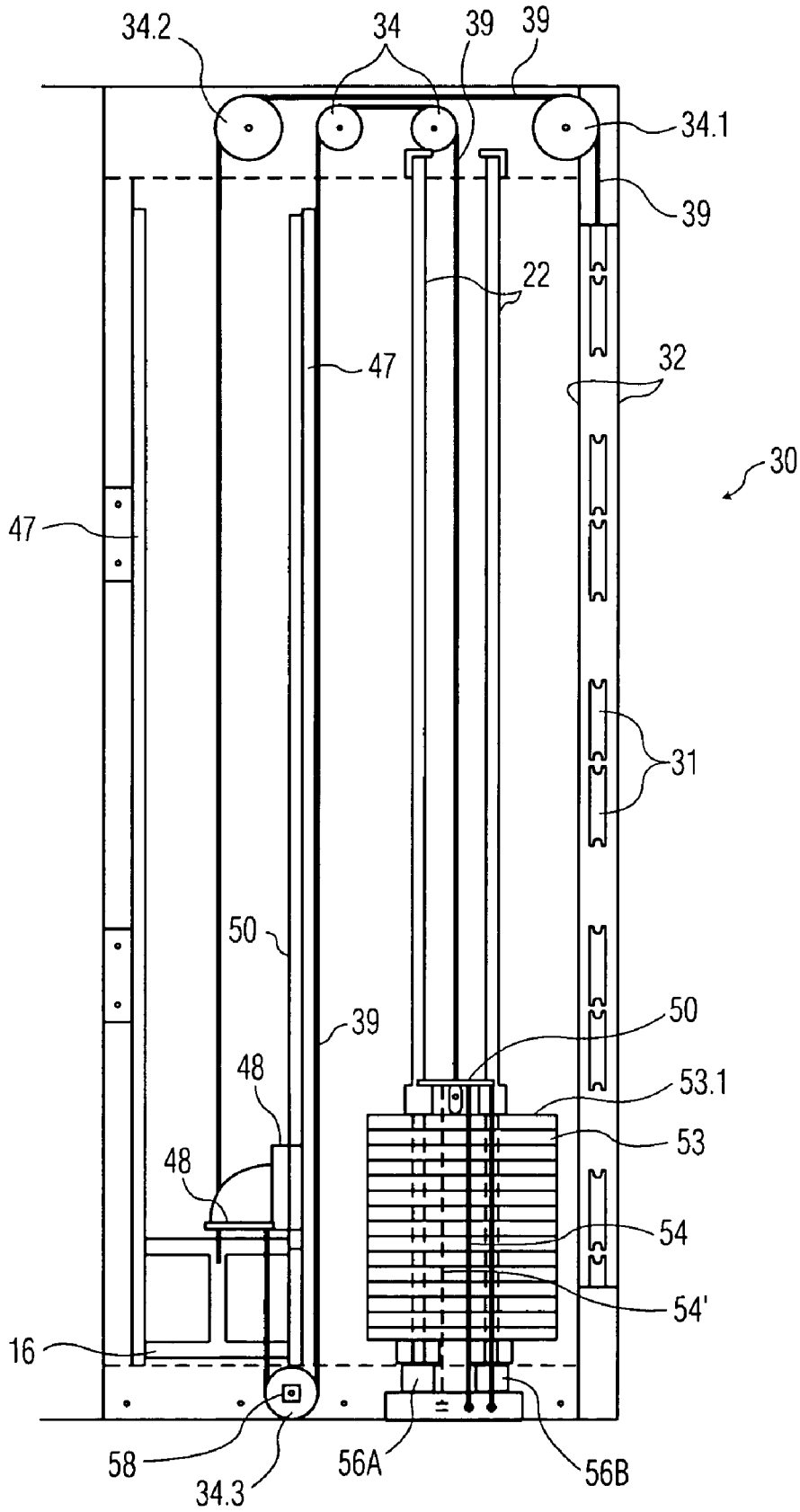
FIG. 4 is a cutaway rear view of the exercise machine of FIG. 2.

FIGS. 2-4 illustrate a multi-cable exercise machine of the type disclosed in my U.S. Pat. No. 6,705,976. This machine 30 includes a plurality of cables 39 which emerge from different exit points around an arc 32 of a circle. Each cable exit point is defined by a pair of pulleys 31 between which one of the cables 39 passes. The proximal end 40 of each cable is attachable to one of any number of handles 41, 42 and 43, respectively.

The cabling of the exercise machine 30, which is described in greater detail in the aforementioned U.S. Pat. No. 6,705,976, passes around various pulleys 34, 34.1, 34.2, 34.3 to a device 48 which applies a small restoring force to each cable. As one of the cables is pulled, the device 48 is lifted on a guide rail 50, causing still another cable 39' to draw upward one or more weights 53.1 of a weight stack 53.

According to the invention, two load cells 56*a* and 56*b* are mounted beneath the weight stack and the base of the frame to measure the downward force applied by the remaining weights that are not lifted when one or more of the cables 39 are drawn away from the machine by a user. The actual tensile force applied to the cable is determined by subtracting the force applied to the load sensors 56*a* and 56*b* from the total applied weight after the top weight or weights on the weight stack are lifted.

If desired, elastic bands 54 and 54' may be attached between the top plate 50 on the weight stack and the frame of the machine. In this case, individual load cells 45 may be provided at the points of attachment of the pulleys 34 (FIG. 3) to measure the actual tensile force in real time. According to the invention, further sensors 35 may also be provided at the points of egress of the cables 39 to sense the direction, in 3-D space, that each respective cable is pulled by a user.

Figure 5:
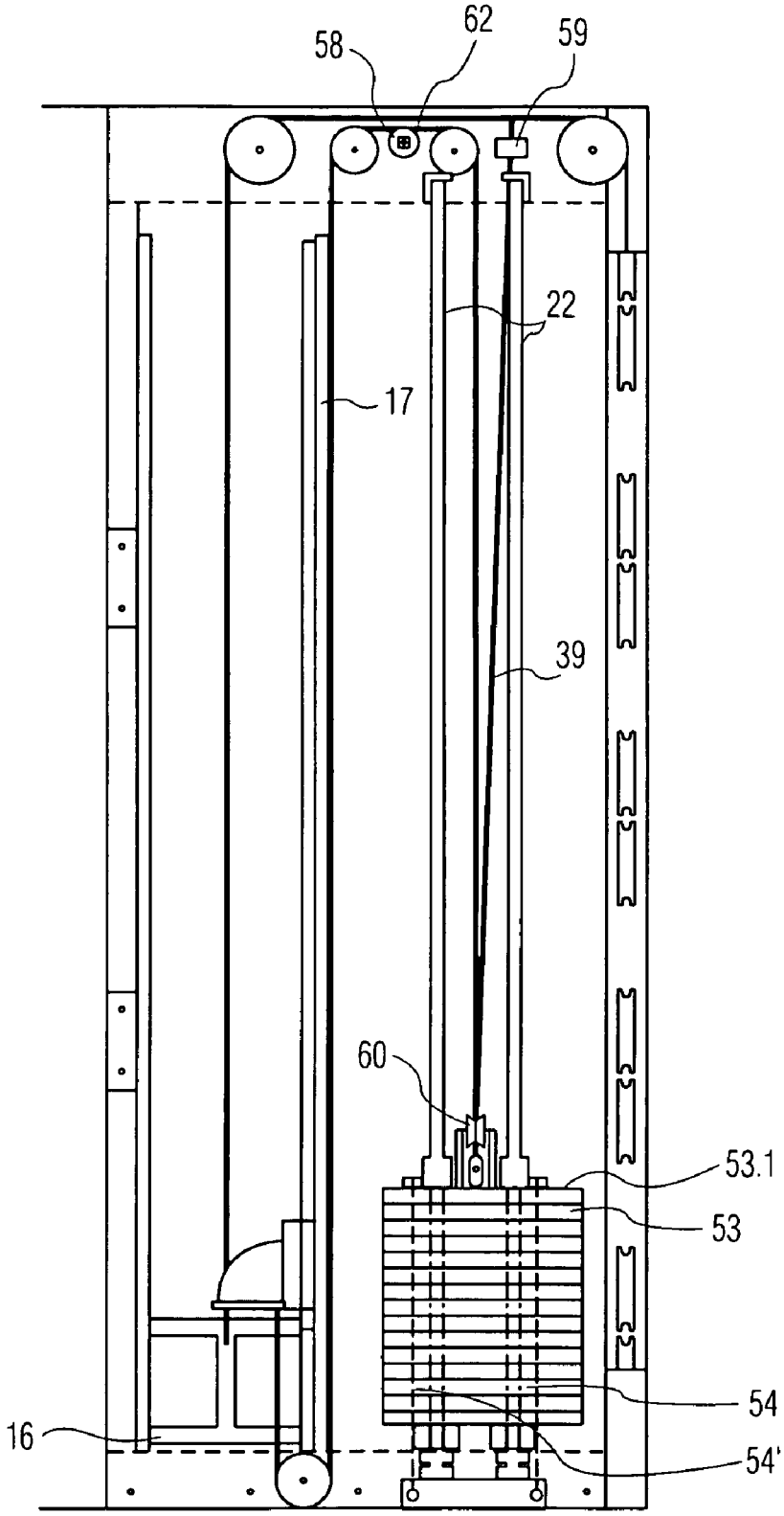
FIG. 5 is a cutaway rear view of an exercise machine, similar to that of FIG. 4, with a 2:1 ratio of the resistance applied to the cable and the tensile force in the cable.

FIG. 5 illustrates a variation of the exercise machine of FIG. 4 in which the cable 39 is passed around a pulley 60 and connected to the upper part of the frame structure through a load cell 59. As with the previous embodiments, the load cell measures the instantaneous tensile force in the cable. However, in this case, the tensile force is reduced by a factor of 2 from the selected weights 53.1 in the weight stack 53 plus the force applied by elastic bands 54.

In the embodiment illustrated in FIG. 4, the instantaneous position of the cable 39 is monitored by an encoder 58.

In the embodiment of FIG. 5, the encoder 58 is associated with a separate pulley 62.

Figure 6:
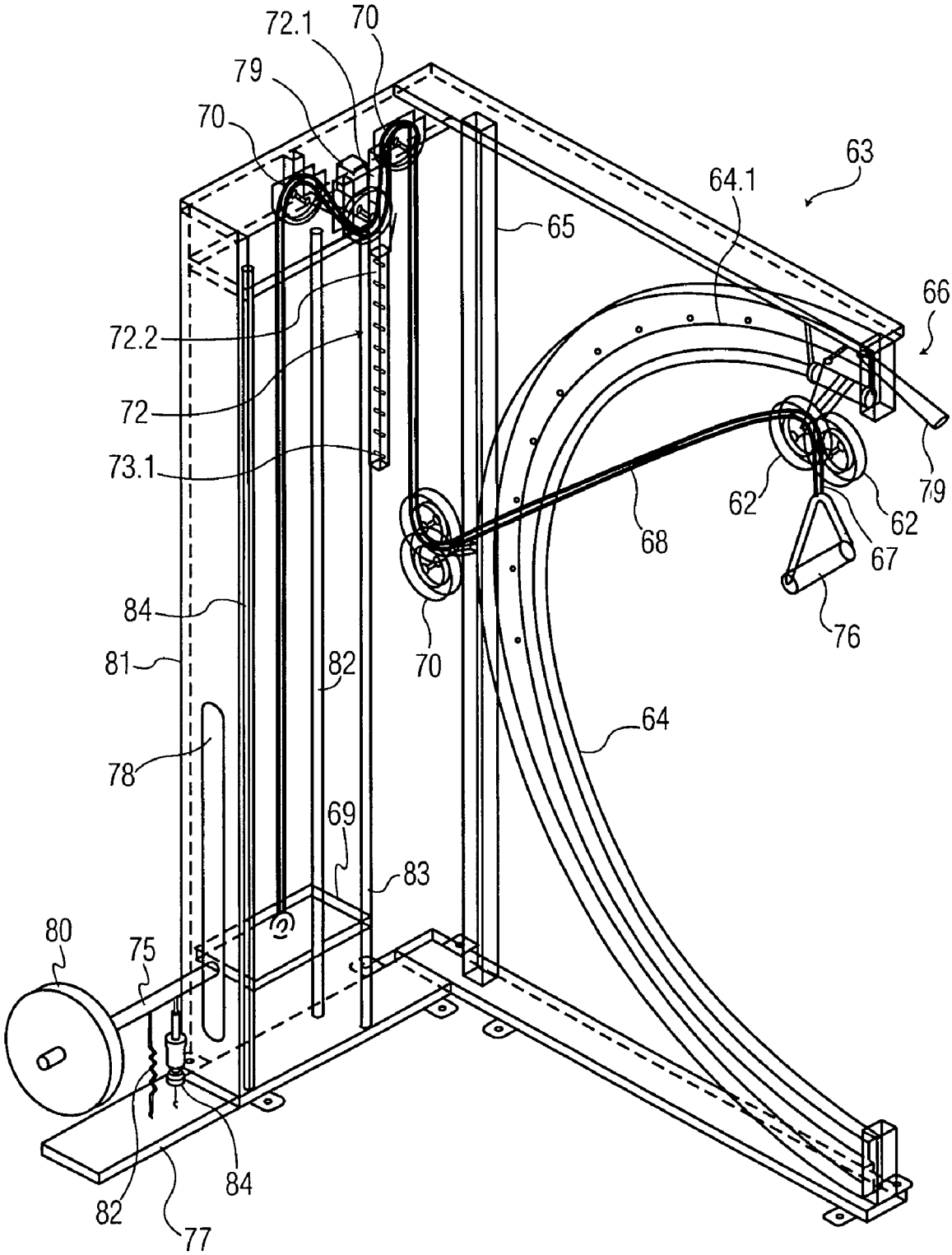
FIG. 6 is a perspective view, partially in phantom, showing still another type of exercise machine according to the present invention.

FIG. 6 illustrates still another type of cable-based exercise machine 63. This machine is similar in structure and operation to the machine 30 shown and described in connection with FIGS. 2-4; however, it operates with a single cable 68 rather than multiple cables as in this prior embodiment. The exit point of the cable from the frame structure of the machine can be adjusted to a selected point along the arc 64 by means of a trolley or slide 66. A sensor (not shown) is provided to produce a signal representing the selected position of the slide or trolley 66, and thus the position of the point of egress of the cable 68 from the machine.

The single cable 68 of the machine 63 has a proximal end 67 that passes through a pair of pulleys 62. The pulley pair 62 is mounted on the movable trolley 66 that can be repositioned along a track 64 and 64.1 attached to the frame structure.

From the handle 76, the cable 68 passes through the pulley pair 62, and is directed through a set of pulleys 70 after which it ultimately extends downward to a plate 69 that travels vertically in a guideway.

Since the distance between the pulley pair 62 and the first pair of pulleys 70 will vary as the trolley 66 is repositioned along the track 64, a cable takeup mechanism, is provided, comprising a pulley 72.1 which is moveable along a moveable bar 73.1. As the trolley is moved, a lever 74 is rotated about a pivot connection to pull the end of a flexible sheath cable. When the lever 74 is moved, the pulley 72.1 travels in a substantially vertical direction up or down in dependence upon the distance the trolley 66 is moved along the arced curve. Once the new position is found for the moveable trolley 66, the lever 74 is moved back causing a pin to slide into a corresponding hole in the vertical rod 73.1, holding the pulley 72.1 in place.

The source of resistance in this embodiment is considerably simpler than that of the embodiment described above. In this embodiment the distal end of the cable 68 is attached to a plate 69 which is constrained to move vertically by vertical tracks 81, 82, 83, 84 arranged in each corner. This plate 69 serves as a force transfer device for the resistance.

Extending outward from this plate 69 is a rod of suitable size and diameter to hold one or more disk shaped weights 80. As in the case of the previous embodiment, one or more tension springs 82 or dampers 84 may be connected between the rod and a frame member 77 which protrudes outward from the bottom of the exercise equipment.

According to the invention, a load sensor 79 is provided on the bracket which holds the take-up pulley 72.1 to sense the tensile force applied to the cable 68.

Figure 7:
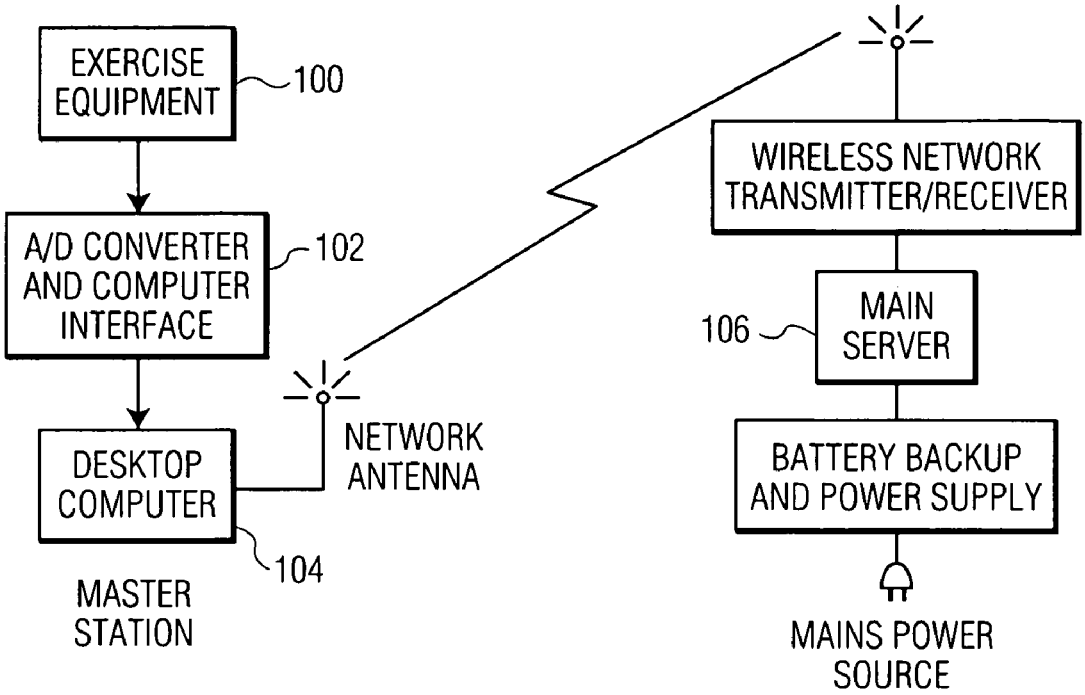
FIG. 7 is a block diagram illustrating the electronic system used with the present invention.

FIG. 7 illustrates the electronic system employed with the present invention to monitor, record, analyze and display the outputs from the various sensors on the exercise equipment. As may be seen, the outputs from the sensors on the exercise equipment 100 are passed through A/D converters and a computer interface 102 and from there to a dedicated desktop computer 104 which may, for example, be positioned near the exercise equipment. The computer stores and accumulates the data as the exercise equipment is utilized, storing the data in a separate file for each successive user of the equipment. The identity of the user can be entered into the computer via a keyboard, by scanning a magnetic or optical stripe on the user's ID card, or by any other means known in the art. The computer is networked with a main server 106 either wirelessly, as shown, or via a cable network, as desired.

Figure 8:
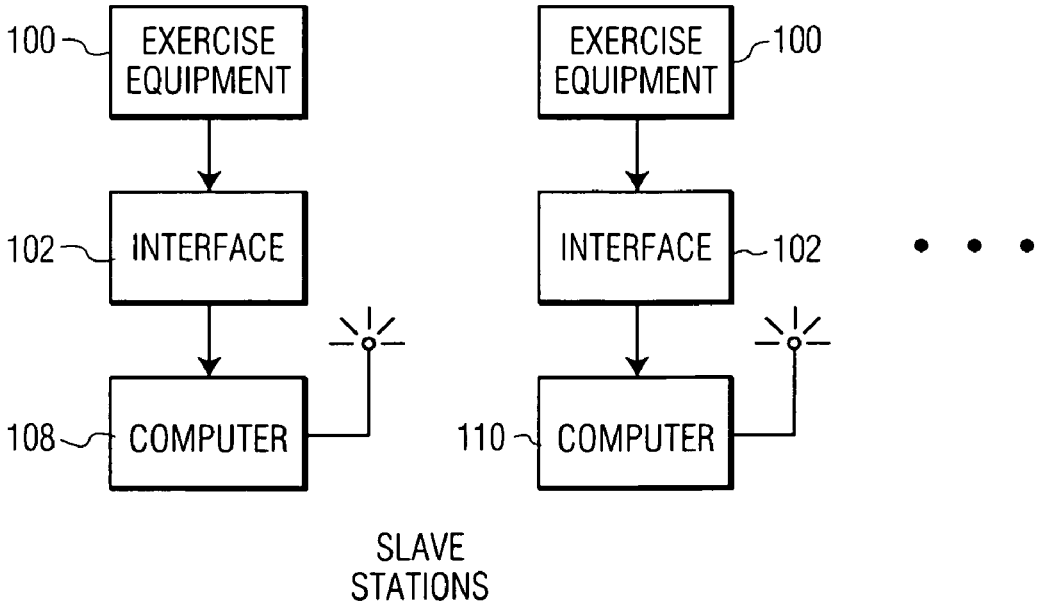
FIG. 8 is a block diagram showing how a plurality of exercise machines may be monitored simultaneously.

FIG. 8 shows an alternative embodiment wherein one of the computers 108 used to collect data from the exercise equipment 100 is used as a "master" to collect data from all the other computers 110 which operate as "slave stations". Again, the connection between computers may operate wirelessly or via LAN cables.

The computers 104, 106, 108 and 110 shown in FIGS. 7 and 8 thus provide electronic means, coupled to receive the electronic signals from the various sensors, for storing values representing the tensile forces and positions of the cable(s) as a function of time.

There has thus been shown and described a novel system for monitoring, recording and reporting exercise parameters for a cable-operated exercise machine which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Exercise equipment comprising, in combination:

(a) a frame structure having at least one cable exit point;

(b) a cable having a proximal end and a distal end, the cable passing through said cable exit point with the proximal end of the cable being attached to a device that enables a user to push or pull the proximal end of the cable in a first direction away from the frame structure;

(c) a resistance device, mounted on the frame structure and coupled to the cable, for applying a tensile force to the cable such that, when the handle at the proximal end of the cable is pulled in the first direction by a user, said resistance device applies an opposing force thereto, and when the handle is released, it causes the cable to move in an opposite, second direction;

(d) a first sensor mounted on said frame structure for producing a first electronic signal representing the instantaneous tensile force in said cable; and (e) an electronic circuit, coupled to receive said first electronic signal, for storing values representing the tensile force in said cable as a function of time.

2. The exercise equipment recited in claim 1, further comprising a second sensor mounted on said frame structure for producing a second electronic signal representing the instantaneous longitudinal position of the cable, and wherein said electronic circuit is coupled to receive said second electronic signal and includes a memory for storing values representing the position of the cable as a function of time.

3. The exercise equipment recited in claim 1, further comprising a third sensor mounted on said frame structure for producing a third electronic signal representing the instantaneous speed of the cable, and wherein said electronic circuit is coupled to receive said third electronic signal and includes a memory for storing values representing the speed of the cable as a function of time.

4. The exercise equipment recited in claim 1, further comprising a fourth sensor mounted on said frame structure for producing a fourth electronic signal representing the instantaneous direction of egress of the cable from the frame structure at the exit point, and wherein said electronic circuit is coupled to receive said fourth electronic signal and includes a memory for storing values representing the direction of the cable as a function of time.

5. The exercise equipment recited in claim 1, wherein said resistance device is a weight stack comprising a plurality of individual weights that may be added and removed to adjust an acceleration-dependent tensile force applied to the cable.

6. The exercise equipment recited in claim 1, wherein said resistance device includes a plurality of springs that may be added and removed to adjust a distance-dependent tensile force applied to the cable.

7. The exercise equipment recited in claim 1, wherein said resistance device includes at least one damping device that may be added and removed to adjust a speed-dependent tensile force applied to the cable.

8. The exercise equipment recited in claim 1, wherein said distal end of the cable is coupled directly to said resistance device, thereby to provide a 1:1 ratio of resistance to tensile force in the cable.

9. The exercise equipment recited in claim 1, wherein said distal end of the cable is connected to said frame structure and is coupled to said resistance device through a cable pulley, thereby to provide a 2:1 ratio of resistance to tensile force in the cable.

10. The exercise equipment recited in claim 1, wherein said electronic circuit includes a digital computer.

11. The exercise equipment recited in claim 10, wherein said digital computer includes a display for displaying the stored values.

12. The exercise equipment recited in claim 10, wherein said digital computer includes a printer for printing a report about the stored values.

13. The exercise apparatus recited in claim 8, wherein said cable passes around a pulley from which it extends substantially vertically to said resistance device, and wherein said first sensor is mounted between said pulley and said frame structure.

14. The exercise apparatus recited in claim 9, wherein said first sensor is mounted between said distal end of said cable and said frame structure.

15. The exercise apparatus recited in claim 1, wherein said first sensor is mounted between said resistance device and a base of said frame structure.

16. The exercise apparatus recited in claim 2, wherein said second sensor is mounted on said frame structure, adjacent said cable.

17. The exercise apparatus recited in claim 16, wherein said cable passes around a pulley and wherein said second sensor is coupled to measure the instantaneous angular position of said pulley.

18. The exercise apparatus recited in claim 3, wherein said cable passes around a pulley and wherein said third sensor is coupled to measure the instantaneous angular speed of said pulley.

19. The exercise apparatus recited in claim 4, wherein said cable passes around a pulley at the point of egress, which pulley is mounted for rotation about a gimbal which allows said pulley to follow the direction that the cable is pulled, and wherein said fourth sensor is mounted to sense the direction that the cable is pulled.

20. The exercise equipment recited in claim 1, wherein said resistance device includes at least two of:

(a) at least one weight;

(b) at least one spring; and (c) at least one damping device.

* * * * *